United States Patent [19]

Fidler, Jr.

[11] Patent Number: 4,494,558

[45] Date of Patent: Jan. 22, 1985

[54] ENCLOSURE AND FRAME THEREFOR

[76] Inventor: Raymond E. Fidler, Jr., P.O. Box 876, Port Aransas, Tex. 78373

[21] Appl. No.: 427,956

[22] Filed: Sep. 29, 1982

[51] Int. Cl.[3] ..... A45F 1/00

[52] U.S. Cl. ..... 135/102; 135/903; 135/117; 135/87

[58] Field of Search ..... 135/900–903, 135/95, 117, 87, 100, 119, DIG. 8, 16, 102, DIG. 5; D25/56, 253; 52/63, 83; 272/146

[56] References Cited

U.S. PATENT DOCUMENTS

| | | | |
|---|---|---|---|
| 381,827 | 4/1888 | Broderick | 135/102 |
| 426,659 | 4/1890 | Carpenter | 135/87 |
| 474,947 | 5/1892 | Collins | 135/102 |
| 1,147,414 | 7/1915 | Lera | 135/117 |
| 1,409,316 | 3/1922 | Smith | 135/100 |
| 2,167,219 | 7/1939 | Sankey | D21/253 X |
| 2,493,833 | 1/1950 | Reynolds | 135/119 |
| 2,837,101 | 6/1958 | Bary | 52/83 |
| 2,926,676 | 3/1960 | Kleinan | 135/117 |
| 2,938,524 | 5/1960 | Benson | 135/119 |
| 4,311,159 | 1/1982 | Wunderlich | 135/100 |

FOREIGN PATENT DOCUMENTS

| | | | |
|---|---|---|---|
| 143943 | 1/1951 | Australia | 135/102 |

*Primary Examiner*—Richard J. Apley
*Assistant Examiner*—S. R. Crow
*Attorney, Agent, or Firm*—Edmond T. Patnaude

[57] ABSTRACT

A tent-like enclosure includes as the supporting frame a generally circular frame member pivotably mounted to and held within a generally U-shaped main frame member, both frame members being constructed of a plurality of flexible, resilient rods held in end-to-end relationship.

8 Claims, 7 Drawing Figures

ENCLOSURE AND FRAME THEREFOR

The present invention relates in its broader aspects to a novel support frame construction which finds use in tents, cabanas, pool and spa covers and the like, and it further relates to enclosures and other protective devices utilizing the said frame construction.

BACKGROUND OF THE INVENTION

Knockdown type frames for use in tents, cabanas, and the like are known in the prior art, and it is also known to utilize flexible rods or tubes in constructing such frames. There is, nevertheless, a need for a simple, lightweight frame over which a fabric or other cover may be placed to provide a protective enclosure, cover or screen.

SUMMARY OF THE INVENTION

Briefly, in accordance with the teachings of the present invention there is provided a new and improved two-part support frame made up of flexible, resilient rods or tubes. One of the frame parts is an arch having its lower ends removably attached to a supporting structure, and the other frame part is a ring pivotably attached at opposite locations thereon to opposite positions on the arch frame for pivotal movement about a horizontal axis within the arch. The frame parts are each made up of a plurality of flexible resilient rods or tubes connected together in end-to-end relationship, and a fabric cover is secured over the ring frame.

In one embodiment of the invention particularly suited for use as a combination spa cover and sun/wind screen, the ring frame is slidable along the upright sides of the arch frame so the the ring frame and the associated cover can be lowered onto the top of the spa when the spa is not in use. When the spa is in use, the ring frame can be lifted a sufficient distance above the spa to provide a sun and/or wind screen for the persons using the spa.

Preferably, the ring frame is pivotable within the arch frame, and in accordance with another aspect of the invention a cord is stretched between opposite locations on the ring frame and is wound around the top of the arch to hold the ring frame in an adjustable angular position within the arch frame.

In another embodiment of the invention, a knockdown base frame, also formed of flexible rods or tubes, supports the arch frame in the upright position. For use as a tent, fabric siding depends from the ring frame. Also a ground cover mounted to the frame may, if desired, be attached to the bottom edge of the fabric siding.

GENERAL DESCRIPTION OF THE DRAWINGS

The present invention will be better understood by a reading of the following detailed description taken in connection with the accompanying drawings wherein.

DETAILED DESCRIPTION OF CERTAIN PREFERRED EMBODIMENTS OF THE INVENTION

Figure 1:
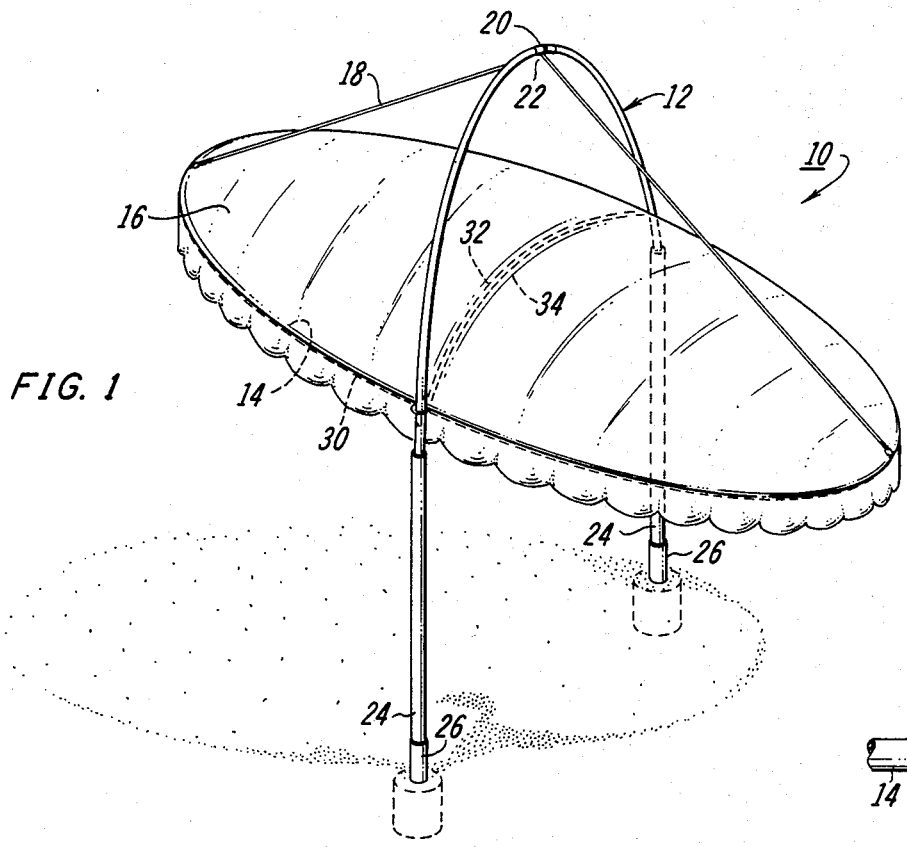
FIG. 1 is a perspective view of a sunshade or cabana embodying the invention.

Referring particularly to FIG. 1, there is shown a sun screen or cabana 10 which comprises as its principal elements a supporting arch frame 12 within which is pivotably mounted a ring frame 14 over which a fabric-like cover 16 is disposed. A cord 18 is stretched between opposite locations on the ring frame 14 and is wrapped once around the top of the arch frame 12 at the location indicated at 20 to hold the ring frame in the adjusted angular position. The arch frame 12 is made up of a plurality of elongated resilient members such as rods or tubes which are interconnected together in end to end relationship in any suitable manner. Preferably, however, the ends of adjoining rods are inserted into opposite ends of a sleeve 22. The internal diameter of the sleeve 22 is such as to provide a tight fit with the rods or tubes which are inserted therein. The lower portions of the arch 12 extend into rigid tubes 24 which are in turn mounted in shorter tubes 26 which may be embedded in the ground in any suitable manner. The rigid tubes 24 provide vertical lower portions for the arch 12. In some applications, the rigid tubes 24 may be omitted and the lower ends of the rod simply positioned within these supporting tubes 26 or held in place in any suitable manner such as by simply inserting the ends of the arch 12 into the ground.

Figure 5:
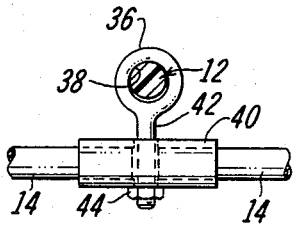
FIG. 5 is a side view showing the manner in which the ring frame is attached to the arch frame in the device shown in FIG. 1.

The ring frame 14 is also made up of a plurality of resilient, flexible rods or tubes which are connected together in end-to-end relationship in the same manner as are the parts which make up the arch frame 12. The ring frame 14 is preferably disposed in generally tubular pockets 30 sewn into the cover 16. An additional resilient rod or tube 32 extends through a tubular pocket 34 sewn diametrically across the cover 16 and is bent into an arch shape when the ring frame is located with the arch 12. The ring frame 14 is preferably attached to the arch frame 12 at opposite locations thereon to provide for pivotable adjustment of the ring frame about a horizontal axis. As best shown in FIG. 5, this pivotal connection is provided by a member 36 having a circular opening 38 through which the arch frame 12 loosely extends. The member 36 is attached to a sleeve or ferrule 40 into the ends of which the parts of the ring frame 14 are tightly fitted. The fastener member 36 has a stud portion 42 which extends through a transverse hole through the sleeve 40 and a nut 44 threaded onto the distal end of the member 36 locks it in place while permitting it to be rotated within the sleeve 40. Inasmuch as both the frame members 12 and 14 are formed of resilient rods or tubes which are rectlinear in the relieved conditions, the frame 12 automatically assumes an arch shape and the frame member 14 automatically assumes a circular shape. However, by positioning the bases of the arch 12 closer together than the natural diameter of the ring frame 14 the ring frame 14 will assume an oval or eliptical shape.

In order to enable the ring frame 14 to be angularly positioned for different sun directions and wind conditions, the cord 18 provides sufficient friction where it is wrapped around the arch 12 to prevent spurious angular movement of the ring frame in the arch frame under normal weather conditions.

It may thus be seen that the device 10 as shown in FIG. 1 is readily disassemblable and portable and may be formed of a plurality of flexible resilient rods or tubes of a length of three feet or the like so as to be collapsed into a very small space for storage and transportation.

Figure 2:
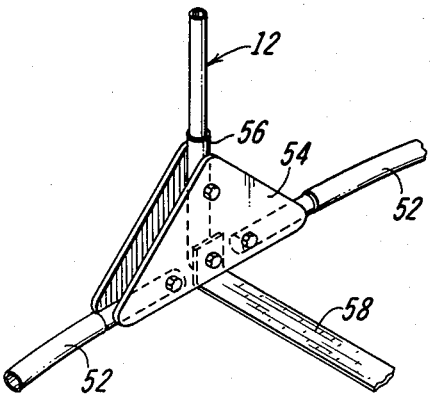
FIG. 2 is a perspective view of a yoke and a portion of a ground frame providing an alternative way of supporting the device of FIG. 1.
Figure 3:
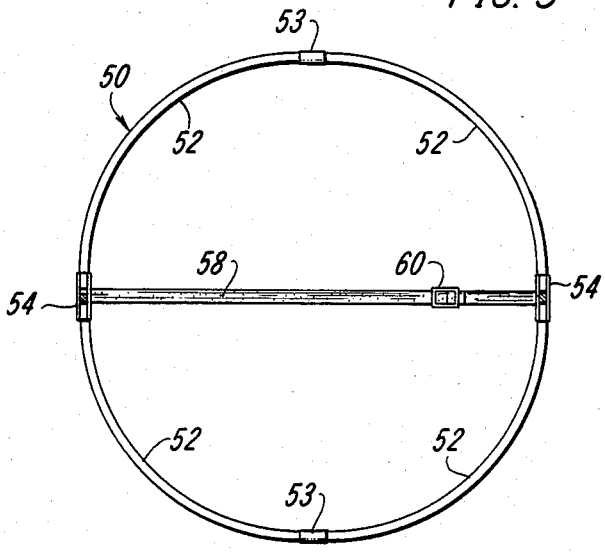
FIG. 3 is a plan view of a base frame embodying the yoke of FIG. 2.
Figure 4:
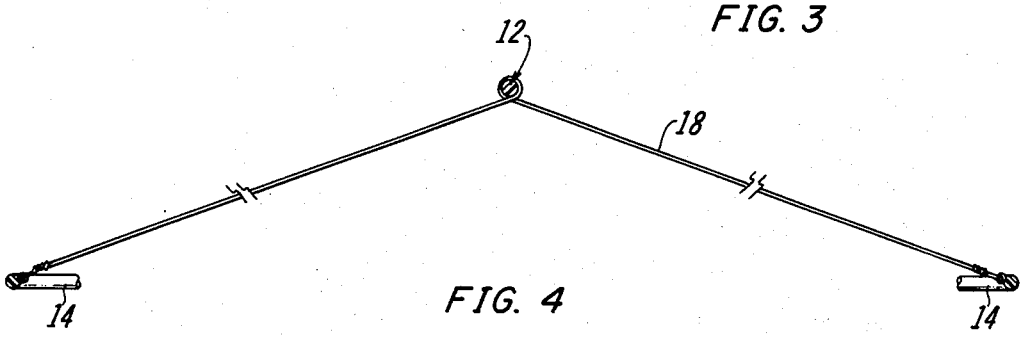
FIG. 4 shows the manner in which the sunshade of FIG. 1 is held in the angularly adjusted position.

Referring to FIGS. 2 and 3, there is illustrated another manner of supporting the arch 12 in position. This embodiment of the invention is particularly suited for use as a tent. As there shown, a generally ring shaped support frame 50 is adapted to rest on the ground and is made up of four resilient rods or tubes 52 which are connected together in end to end relationship by a pair of connector sleeves 53 and a pair of identical yokes 54. As best shown in FIG. 2, each yoke 54 includes a vertical tubular member 56 which is adapted to receive one lower end of the arch frame 12 and two of the segments 52 making up the support ring frame 50.

A flexible strap 58 is connected between the yokes 54 to hold them at the desired spaced apart distance. The natural resiliency of the frame segments 52 would otherwise cause the frame 52 to be circular in shape. However, it is preferred that the base frame be oval in shape wherefor the strap 58 has a length less than the natural diameter of the frame 50. If desired, the strap 58 may include a buckle 60 for adjusting the length thereof to the desires of the user.

Figure 6:
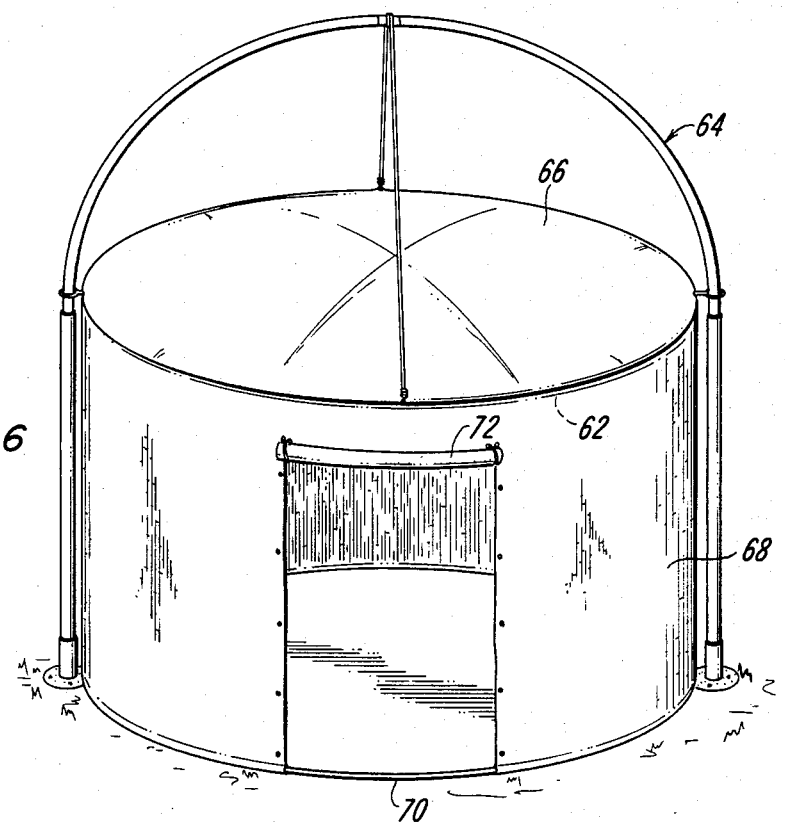
FIG. 6 is a perspective view of a tent embodying the invention.
Figure 7:
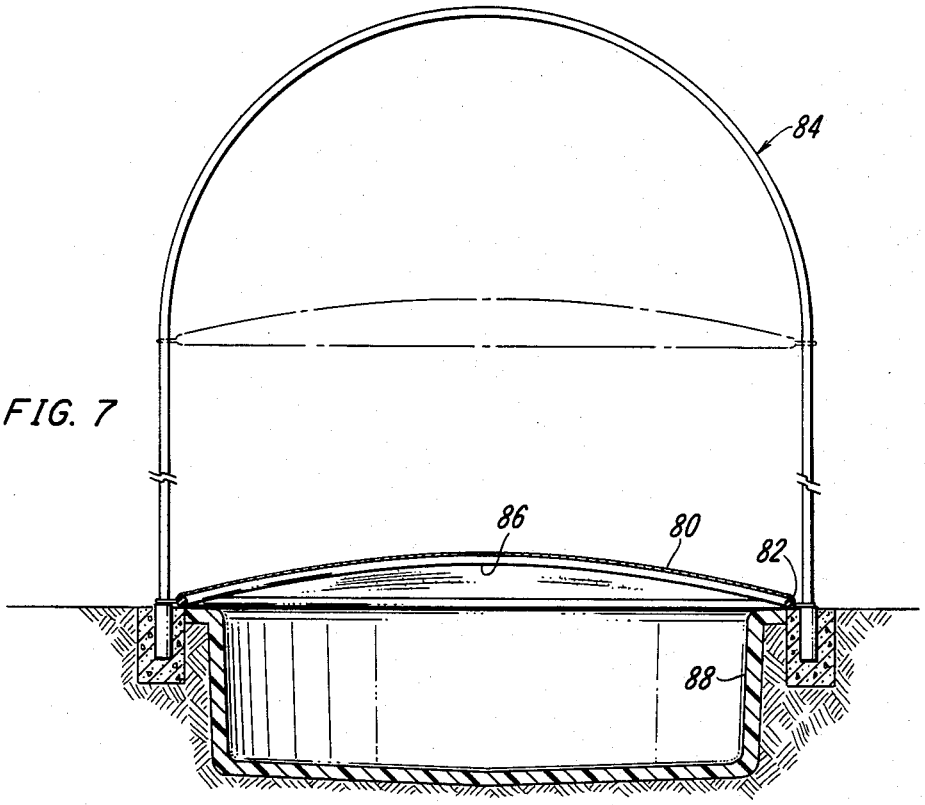
FIG. 7 is a view of a pool or spa cover embodying the invention.

Referring to FIG. 6 there is shown the present invention as embodied in a tent. In this embodiment of the invention a ring frame 62 of similar construction to the ring frame 14 is mounted within an arch frame 64 of similar construction to the arch frame 12. A cover 66 overlies the ring frame 52 and has a depending skirt 68 which is preferably attached at the bottom to a ground cover or base frame 70. As shown, the skirt 68 includes a roll up door 72. If desired, windows may also be provided as well known in the art. As in the case of the device 10 shown in FIG. 1, the tent of FIG. 6 is disassemblable into a plurality of relatively short frame parts and a fabric tent cover which can be folded into a compact condition for easy storage and transportation.

FIG. 6 illustrates another embodiment of the invention wherein a spa cover 80 is adapted to be disposed directly over a pool or spa 82 for protecting the spa from the elements. However, the cover 80 can be elevated a substantial distance above the spa to provide a sun shade for the persons using the spa. Moreover, when in the elevated position the cover 80 can be angularly adjusted for optimum use as a sun shade and/or wind screen. As in the other embodiments of the invention, the cover 80 includes a ring frame 82 which is pivotably and slidably mounted to an arch frame 84. Inasmuch as a spa cover is a more or less permanent installation, the arch frame 84 may be a single relatively long rod or tube. However, the arch frame 12 is ordinarily formed of at least two lengths of rod or tube connected together in end-to-end relationship. Similarly, the ring frame 82 is preferably formed of a plurality of individual rod or tube segments. A flexible, resilient cross frame member 86 is also provided in conjunction with the ring frame 82 to hold the cover 80 in a slightly dished, inverted condition to give it a better esthetic appearance. In this embodiment of the invention, rather than utilizing the stretched cord to hold the cover in an adjusted angular position, it is preferred to utilize connectors which provide sufficient friction to prevent spurious angular movement of the cover 80 within the arch frame 84.

While the present invention has been described in connection with a particular embodiment thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed:

1. A multi-purpose support frame, comprising in combination an upright arch frame formed of a plurality of elongated, flexible resilient members connected together in end-to-end relationship, said members being disposed in a common vertical plane, a ring frame formed of a plurality of elongated flexible resilient members connected together in end-to-end relationship, and lying in a common plane, said ring frame being disposed within said arch frame, and mounted to said arch frame at opposite positions on said ring frame for slidable movement along said arch frame and for pivotal movement of said ring frame about an axis through said opposite positions providing for angular positioning of said ring frame within said arch frame, said ring frame members lying in a common plane at all angular positions of said ring frame.

2. A support frame as set forth in claim 1 comprising a cord stretched between opposite locations on said ring frame with its intermediate portion wrapped around said arch frame providing for selective adjustment of said angular position of said ring frame and to retard spurious pivoting of said ring frame in said arch frame at said angular position.

3. A sun shade comprising in combination a support frame according to claim 1, and a fabric-like cover secured to said ring frame.

4. A sun shade according to claim 3 wherein said cover comprises pocket means receiving said ring frame.

5. A support frame according to claim 1 comprising a base frame formed of a plurality of elongated, flexible, resilient members interconnected in end-to-end relationship, the lower end portions of said arch frame being attached to opposite locations on said base frame.

6. A support frame according to claim 5 comprising a flat, flexible adjustable in length strap connected between said opposite locations on said base frame providing for changing of the shape of said base frame.

7. A support frame according to claim 5 comprising first and second yokes pivotably connected to said base frame at said opposite locations, said arch frame being connected to said yokes.

8. A tent, comprising in combination a support frame according to claim 7, and a fabric-like cover secured over said ring frame and having a skirt portion depending into operative engagement with said base frame.

* * * * *